US005951161A

United States Patent [19]

Blagg

[11] Patent Number: 5,951,161

[45] Date of Patent: Sep. 14, 1999

[54] APPARATUS FOR PREPARATION OF TANK MIXTURES FOR HEAT SENSITIVE BIOFUNGICIDES

[75] Inventor: Billy R. Blagg, Fresno, Calif.

[73] Assignee: Elf Atochem North America, Inc., Philadelpia, Pa.

[21] Appl. No.: 08/921,182

[22] Filed: Aug. 29, 1997

[51] Int. Cl.[6] ..... B01F 15/02

[52] U.S. Cl. ..... 366/152.6; 366/153.1

[58] Field of Search ..... 366/152.6, 153.1, 366/155.1, 156.1, 182.1

[56] References Cited

U.S. PATENT DOCUMENTS

| | | | |
|---|---|---|---|
| 2,574,391 | 11/1951 | Herrly | 366/155.1 |
| 3,326,815 | 6/1967 | Werner et al. | 366/168.1 |
| 3,948,490 | 4/1976 | Troope | 366/152.6 |
| 4,242,841 | 1/1981 | Ushakov et al. | 366/152.6 |
| 4,436,703 | 3/1984 | Lane | 366/156.1 |
| 4,518,261 | 5/1985 | Sekimoto et al. | 366/155.1 |
| 4,779,186 | 10/1988 | Handke et al. | 366/156.1 |
| 4,830,509 | 5/1989 | Gulmatico, Jr. | 366/156.1 |
| 4,859,072 | 8/1989 | Fey et al. | 366/156.1 |
| 4,955,723 | 9/1990 | Schneider | 366/168.1 |
| 5,174,651 | 12/1992 | Gaddis | 366/156.1 |
| 5,452,954 | 9/1995 | Handke et al. | 366/152.5 |

OTHER PUBLICATIONS

Aspire Biofungicide Technical Bulletin dated Feb. 1997.
Decco Fungicide Technical Bulletin dated Oct. 1996.

*Primary Examiner*—Tony G. Soohoo
*Attorney, Agent, or Firm*—Seidel, Gonda, Lavorgna & Monaco, PC; Stanley A. Marcus; Gilbert W. Rudman

[57] ABSTRACT

An apparatus for preparing a biofungicide mixture for application to harvested fruit. The apparatus includes a storage container for holding a dry biofungicide component. The storage container is attached to a conduit which has a screw conveyor rotatably disposed within it for transferring a desired amount of the dry biofungicide component to a preparation tank. A feed motor is attached to the conveyor and controls its rotation. An agitator mounted within the preparation tank mixes the biofungicide component with water to form a biofungicide mixture. A water level control device determines the level of the liquid within the tank. The water level control device controls flow of water into the preparation tank by actuating a valve along a water conduit. The water level control device also controls the startup of the feed motor. A transfer pump transfers biofungicide mixture from the preparation tank to an application tank. A mixture level control device determines the level of the mixture contained within the application tank. The mixture level control device controls the operation of the transfer pump. A delivery pump suctions biofungicide mixture from the application tank and pumps the biofungicide through a discharge tube to the harvested fruit.

11 Claims, 2 Drawing Sheets

CONTROLLER
CONTROLLER
MOTOR
MOTOR
PUMP
PUMP
LEVEL CONTROL DEVICE
LEVEL CONTROL DEVICE
10
12
14
14
16
18
20
22
24
26
26A
28
32
32A
34
36
38
40
42
44
46
48
50
52
54
54A
54B
56
58
58
60
62
64
66
68
70
70A
70B
72
74
76
80
82
84

APPARATUS FOR PREPARATION OF TANK MIXTURES FOR HEAT SENSITIVE BIOFUNGICIDES

FIELD OF THE INVENTION

The present invention relates to an apparatus for preparing a heat sensitive biofungicide mixture for application to a food product. More particularly, the apparatus is designed to minimize waste of biofungicide by preparing a prescribed amount of biofungicide mixture for treatment of post-harvest fruit.

BACKGROUND OF THE INVENTION

Disease is one of the main causes of reduced crop yield after harvest. The most common forms of such diseases are fungal and bacterial plant pathogens, such as mold. In citrus fruits, the most common forms of mold are green mold (caused by *Penicillium digitatum*) and blue mold (caused by *Penicillium italicum*). In apples, the most common forms of mold are blue mold (caused by *Penicillium expansium*) and grey mold (caused by *Botrytis cinerea*).

In order to maximize the amount of post-harvest product, it has become essential to treat the fungal and bacterial pathogens with pesticides and fungicides. Treatment can be accomplished in many different ways, for example, submersion in fungicidal treatment tanks, wrapper impregnation, or fumigation in a containment room. The most common method for applying fungicides is by suspending a fungicide powder in water, then applying the mixture to the fruit with a sprayer.

Since there is a significant cost associated with the application of a fungicide to a product, the harvesting/packaging company must determine whether the cost associated with the fungicidal process can be offset by the anticipated additional yield. As such, it is important to minimize the cost associated with a fungicidal application process.

Synthetic pesticides are utilized quite extensively in all commercial fresh product packing houses to assist in disease treatment. Recently, biological controlling agents were developed for post-harvest use. Biological controlling agents (biofungicides) are living organisms generated to inhibit or eradicate fungi. Since biofungicides are living organisms, they are generally highly susceptible to environmental changes. For example, many biofiungicides are susceptible to temperature changes or exposure to elevated/reduced temperatures for an excessive amount of time. As such, new types of equipment and application techniques are needed to protect the viability of the biofungicides to make their use economically feasible.

One biofungicide commonly used for post-harvest treatment of citrus fruits is Aspire® (*Candida oleophila*), sold by the Decco Department of the Agrichemical Division of Elf Atochem North America, Inc, Monrovia, Calif. Decco I-182® (also *Candida oleophila*), a biofungicide commonly used for post-harvest treatment of pome fruit, such as apples, is also sold by the Decco Department of the Agrichemical Division of Elf Atochem North America, Inc. These biofungicides are both naturally occurring yeast that is typically supplied as dry, meltable granules in a vacuum packed container. The dry biofungicide is then hydrated and suspended in water prior to use.

Candida cells, such as those present in Decco I-182® and Aspire® biofungicide, when packaged in one pound vacuum packed containers (non-suspended) can tolerate heat well.

For example, Decco I-182® and Aspire® biofungicides are viable at 4° C. for 400–600 days in the original package. When exposed to an elevated temperature of 40° C., Decco I-182® and Aspire® bioftingicides remain viable for approximately 5 days in their vacuum packed state. When not in their vacuum packed state, Aspire® and Decco I-182 ® biofungicides are viable at 4° C. for about 60 days if stored in a dry location.

However, when the Aspire and Decco I-182® biofungicides are placed in an aqueous suspension at ambient temperature (25° C.), which is the typical application environment, the Candida cells deteriorate rapidly after about 36 hours. As such, the biofungicidal suspension has a shelf life of between about 24 and 36 hours depending on the temperature at which it is stored.

It is conventional in the post-harvest treatment of fruits to prepare sizable batches of the biofungicides in large tanks (e.g., 100 gallons or more) for use during the day to treat harvested product. The biofungicides are prepared by adding biofungicidal powder or granules to water to create a suspension. One pound of Aspire® or Decco I-182® biofungicide will treat approximately 20 tons of fruit. A typical mid-sized fruit packing house processes about 30 tons of fruit per hour. Accordingly, between about 12 and 14 pounds of Aspire® and/or Decco I-182® biofungicide is utilized in an eight hour day. Typically, a 100 gallon mixture is prepared in a large tank at the beginning of the day and used throughout the day. The benefit to preparing large batches of the suspension is that only one batch preparation is needed, thereby minimizing the stoppage of the fruit treatment process to make additional mixture.

The major drawback in creating large batches of biofungicide is short-term viability of the suspension. If the treatment process is suspended during the day, the remaining portion of the suspension must be used within 36 hours or else the tank contents must be discarded and a fresh batch made when treatment resumes. It has been quite common to have to dispose of up to 25% of a batch (i.e., 25 gallons) because it has exceeded its useful life. Also, since it is impossible to predict the actual run time in a fruit packing house, additional batches of biofungicidal mixture must sometimes be prepared during the day. The costs associated with discarding the non-viable biofungicide and the time required to prepare new batches of biofungicide mixture are quite significant.

A need, therefore, exists for a system for preparing biofungicidal suspensions for treating harvested fruits which minimizes wastage during shutdown and which does not delay the treatment process.

SUMMARY OF THE INVENTION

The present invention relates to an apparatus for preparing a biofungicide mixture for application to harvested fruit. The apparatus includes a storage container for holding a dry biofungicide component. The storage container is attached to a conduit which has a screw conveyor rotatably disposed within it. The conveyor transfers a desired amount of the dry biofungicide component through the conduit to a preparation tank. A feed motor is attached to the conveyor and controls its rotation.

An agitator is mounted within the preparation tank and mixes the biofungicide component with water in the preparation tank to form a biofungicide mixture.

A water level control device is mounted to the preparation tank and determines the level of the liquid within the tank. The water level control device controls flow of water into the preparation tank by actuating a valve along a water conduit. The water level control device opens the valve when the level of the liquid within the preparation tank is below a low threshold level. The water level control device closes the valve when the level of the liquid within the preparation tank is above a high threshold level.

The water level control device also controls the conveyance of the dry biofungicidal component by starting the feed motor when the level of the liquid within the preparation tank is below a low threshold level, A transfer pump transfers biofungicide mixture from the preparation tank to an application tank.

A mixture level control device is mounted to the application tank and determines the level of the mixture contained within the tank. The mixture level control device controls the operation of the transfer pump. Specifically, the mixture level control device turns the transfer pump on when the level of the biofungicide mixture within the application tank is below a low threshold level, and turns the transfer pump off when the level of the biofungicide mixture within the application tank is above a high threshold level.

A delivery pump suctions biofungicide mixture from the application tank and pumps the biofungicide through a discharge tube to the harvested fruit.

The present invention minimizes the amount of biofungicidal mixture that is wasted in a daily run by automatically and continuously preparing a prescribed amount of biofungicide mixture.

The precise and continuous mixing that results from the present invention provides a substantial operational savings over prior art batch systems.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DISCUSSION OF THE PREFERRED EMBODIMENTS

Figure 1:
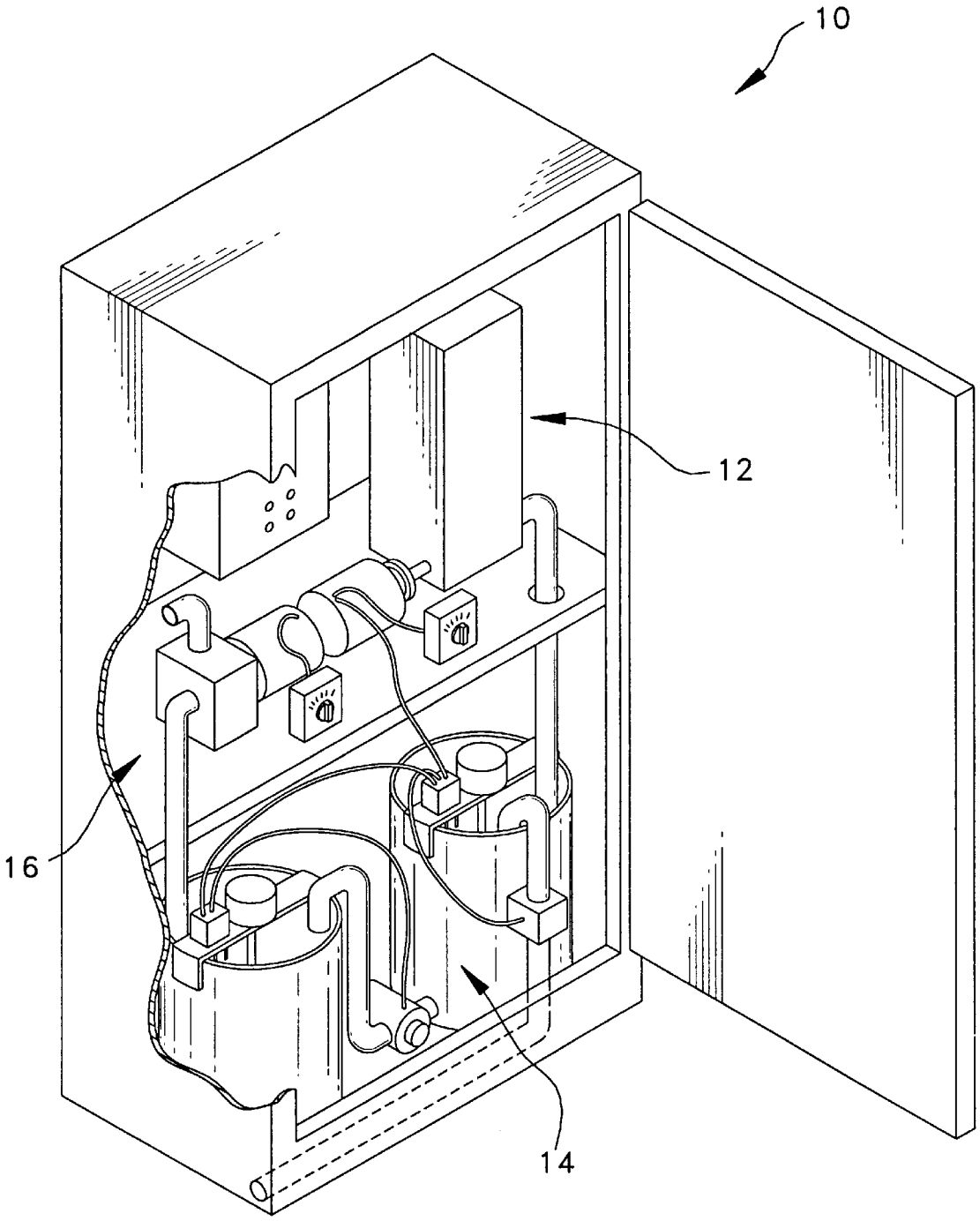
FIG. 1 is an isometric view of an apparatus according to the present invention.

Referring now to the drawings, wherein like reference numerals illustrate corresponding or similar elements throughout the several views, FIG. 1 illustrates an apparatus 10 for preparing a biofungicidal mixture for treatment of fruit. The biofungicidal mixture is formed by mixing granular biofungicide with a liquid (e.g., water). The mixture is then applied to harvested fruit for preventing and/or inhibiting the growth of fungi. The biofungicide preparation apparatus 10 includes a dry biofungicide feeding system 12, a biofungicidal mixing system 14, and a biofungicide delivery system 16. Each system will be discussed in detail hereinbelow. The apparatus 10 is shown in FIG. 1 as a self-contained unit. However, it is also contemplated that each system can be separately housed.

Dry Biofungicide Feeding System

Figure 2:
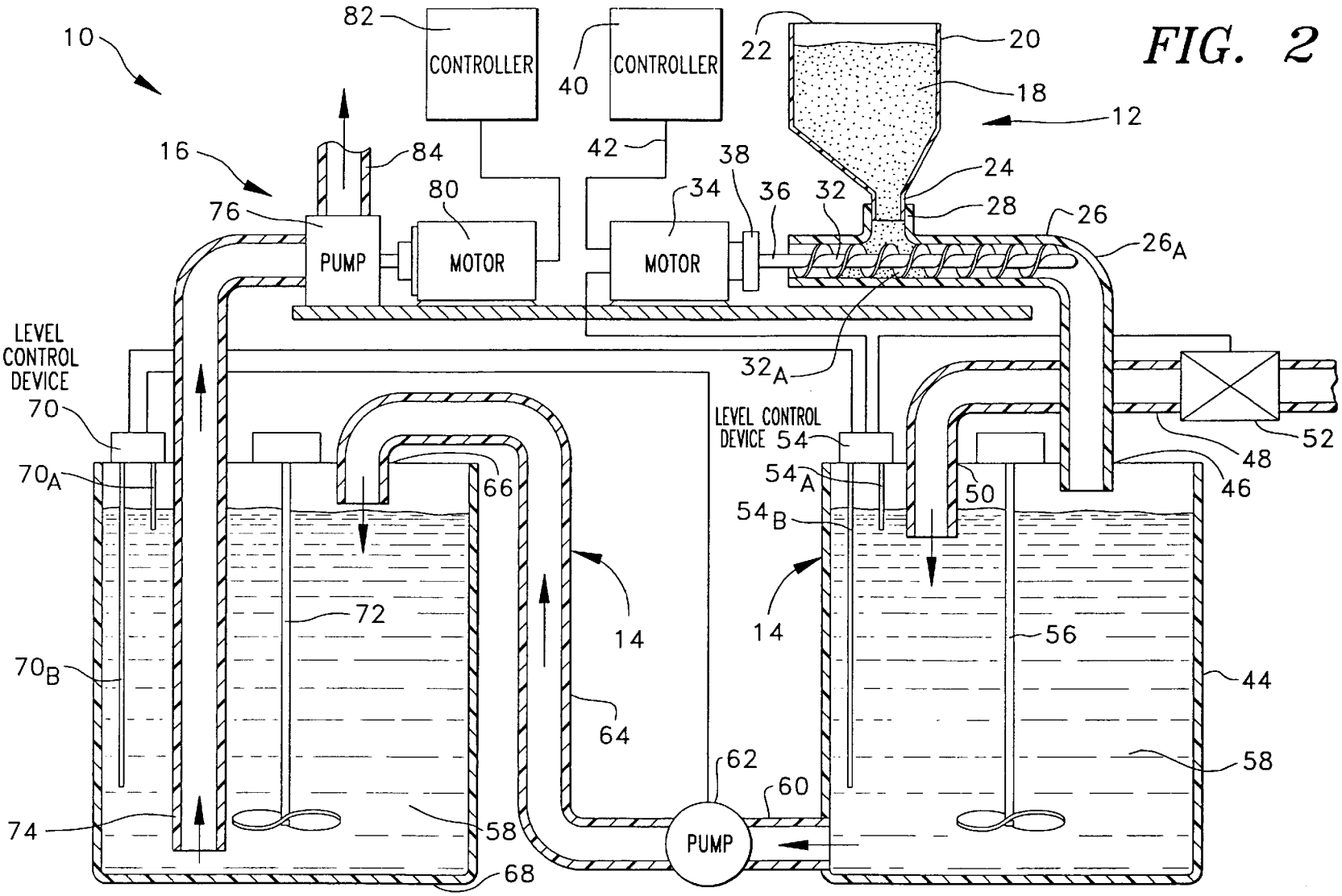
FIG. 2 is schematic representation of an apparatus according to the present invention.

Referring to FIG. 2, the biofungicide feeding system 12 is configured to supply dry biofungicide granules or powder 18 into the mixing system 14. The biofungicide granules or powder 18 are contained within a storage container 20. The storage container 20, preferably, is in the shape of a funnel with an access opening 22 for receiving a supply of granular or powdered biofungicide. An outlet port 24 is formed on the storage container 20 downstream from the access opening 22. The outlet port 24 is adapted to permit egress of granular or powdered biofungicide from the storage container 20. For the sake of simplicity, both the granular and powdered biofungicide will be referred to as the biofungicide component 18. The storage container 20 is preferably made from stainless steel material, although other materials may be interchanged therewith provided the materials used are substantially inert when exposed to the biofungicide component 18.

A conduit 26 is located adjacent to the outlet port 24 and has a conduit inlet 28 which is in communication with the biofungicide component 18 contained within the storage container 20. Preferably, the outlet port 24 of the storage container 20 is attached to or disposed within the conduit inlet 28 of the conduit 26. The conduit 26 also includes a conduit outlet 30 located at a distal end of the conduit 26 downstream from the conduit inlet 28. As will be discussed in more detail hereinbelow, the biofungicide component is channeled from the conduit inlet 28 to the conduit outlet 30.

A conveyor 32 is preferably movably disposed within the conduit 26. The conveyor 32 is configured to convey, transport or otherwise cause the biofungicide component 18 to transfer from the conduit inlet 28 to the conduit outlet 30. In one preferred embodiment illustrated in FIG. 2, the conveyor 32 is a screw-type conveyor with a continuous flight $\mathbf{32}_A$ formed on it. Rotation of the screw conveyor 32 within the conduit 26 causes the flight $\mathbf{32}_A$ to push or feed the biofungicide component 18 through the conduit 26 toward the conduit outlet 30. Although a screw-type conveyor 32 is shown in the preferred embodiment, alternate types of conveying systems could be substituted therefor and are well known to those skilled in the art.

The conveyor 32 preferably extends from slightly upstream of the conduit inlet 28 to a location downstream from the conduit inlet 28. For example, as illustrated in FIG. 2, the flight $\mathbf{32}_A$ on the screw conveyor 32 extends from before the conduit inlet 28 to an elbow $\mathbf{26}_A$ in the conduit 26. The conveyor flight $\mathbf{32}_A$ pushes the biofungicide component 18 to the elbow $\mathbf{26}_A$ in the conduit 26 after which the biofungicide component 18 will travel downward through the conduit 26 by the force of gravity.

One benefit provided by the use of a screw conveyor is that the flight $\mathbf{32}_A$ also functions as a shut-off valve to prevent the biofungicide component 18 from continually pouring out of the storage container 20.

A feed motor 34 is used to move the conveyor 32 within the conduit 26. In the illustrated embodiment, a shaft 36 on the screw conveyor 32 is engaged with the feed motor 34 through a sleeve 38. Rotation of the feed motor 34 causes corresponding rotation of the screw conveyor 32 within the conduit 26. The feed motor 34 is preferably a Bodine 1/8 horsepower DC gear motor, manufactured by Bodine Electric Co., Chicago, Ill.

A feed controller 40 is electrically connected to the feed motor 34 through control line 42. The feed controller 40 provides control over the speed and operation of the feed motor 34 and conveyor 32. Thus, the amount of biofungicide component 18 can be varied by the feed controller 40 to permit variation of the biofungicide concentration in the resulting mixture. The feed controller 40 is preferably a Dayton DC Speed Control, Model No. 4Z527E manufactured by Dayton Electric Mfg., Niles, Ill.

In one exemplary embodiment of the invention, the conduit 26 is an assembly of polyvinylchloride (PVC) pipe having a ½ inch internal diameter. The conveyor 32 is a ⅝ths inch diameter wood drill bit. The tolerances in the pipe provide sufficient clearance for the ⅝ths inch drill bit.

When the biofungicide feed system 12 is in operation, the speed of the feed motor 34, which is set by the controller 40, determines the number of revolutions per minute of the screw conveyor 32 and, therefore, the amount of dry biofungicide component 18 that is channeled through the conduit over a given time period.

It may be desirable to incorporate level sensors (not shown) in the storage container 20 for detecting and warning of a low level of biofungicide component 18 within the container.

While the preferred system utilizes a conveyor and feed motor to control the amount of biofungicide component 18 fed into the preparation tank 44, a valve could instead be substituted into the system. The valve could be mounted to a conduit leading from the outlet port 24 and would be opened and closed to permit the desired amount of biofungicide component 18 to pour out of the container 20.

The Biofungicide Mixing System

The biofungicide feeding system 12 discussed above conveys a desired amount of dry biofungicide to the biofungicide mixing system 14 for mixing with a liquid, such as water.

The mixing system 14 includes a preparation tank 44 which has an opening 46 formed on or near its top to receive the biofungicide component 18. Preferably, the end of the conduit 26 extends partially into the preparation tank 44 such that the conduit outlet 30 is located within the interior of the preparation tank 44. Alternatively, the conduit outlet 30 could attach to a port (not shown) in the preparation container 44.

A flow of liquid for mixing with the biofungicide component 18 is provided to the preparation tank 44. The liquid hydrates the biofungicide component 18 to create a biofungicide mixture. The liquid is preferably water which is supplied via a water conduit 48 (the water flow is identified by the arrow). The water conduit 48 extends into the preparation tank 44 through an opening 50. The water conduit 48 is attached to a water source (not shown) for providing water when needed.

A solenoid valve 52 is located along the water conduit 48 and controls the flow of water through the water conduit 48 and into the preparation tank 44. Actuation of the solenoid valve 52 between its open and closed positions is provided by signals sent from a water level control device 54. The water level control device 54 includes high and low water level detectors or probes ($54^A$ and $54_B$, respectively) positioned within the preparation tank 44. Preferably the water level device is a Warrick Liquid Level Control Relay (Model No. 1G1DO-115UOH) with a two probe Warrick Control (Model No. WAR3E2A), both manufactured by Warrick Controls, Barkley, Mich.

When the water level control device 54 senses that the liquid level (either water or mixture) has fallen below the low water level detector $54^B$, the control device 54 sends a signal to the solenoid valve 52 to open the valve and permit water to flow into the preparation tank 44. As soon as the water level control device 54 senses that the liquid level has risen above the high water level detector $^{54}$A, the control device 54 sends a signal to the solenoid valve 52 to close the valve and stop flow of water into the preparation tank 44.

The preparation tank 44 is preferably a five gallon container made from material, such as plastic, which is substantially inert to the biofungicide mixture contained within it.

An agitator 56 is disposed within the preparation tank 44 and operates to mix the water and biofungicide component together. The agitator is preferably an Air Motor, Model No. 4Z411, manufactured by Coast Parts Company of America, Buffalo Grove, Ill. The agitator 56 includes an air motor which continuously drives an impeller located within the preparation tank 44. The agitator 56 is conventional in the art and, hence, no further discussion is needed.

The combination of the water and the biofungicide component produces a biofungicide mixture 58 which is ultimately utilized to treat the post-harvest fruit.

A first transfer pipe 60 is attached to the bottom of the preparation tank 44 and is in communication with the interior of the preparation tank 44. The first transfer pipe 60 can be attached to the preparation container 44 by any conventional means known to those skilled in the art.

The opposite end of the first transfer pipe 60 preferably attaches to an inlet on the suction side of a transfer pump 62. The transfer pump 62 is operative for pumping biofungicide mixture 58 out of the preparation tank 44. The transfer pump 62 is preferably a Teel pump, Model No. 1P579F, manufactured by Dayton Electric Mfg., Niles Ill. Any conventional transfer pump 62 could be utilized for pumping the biofungicide mixture and, thus, a further description of the transfer pump is not necessary.

A second transfer pipe 64 is attached to the outlet or discharge side of the transfer pump 62 and receives a pressurized flow of the biofungicide mixture 58 from the transfer pump 62. The downstream end of the second transfer pipe 64 preferably extends into an opening 66 in or near the top of an application tank 68. Preferably, the end of the second transfer pipe 64 extends partially into the application tank 68. In an alternate configuration (not shown), the second transfer pipe 64 could attach to a port or nipple in the application tank 68.

The application tank 68 is preferably a five gallon container made from material, such as plastic, which is substantially inert to the biofungicide mixture.

Similar to the preparation tank 44, the application tank 68 has a mixture level control device 70. The mixture level control device 70 includes high and low mixture level detectors or probes ($70_A$ and $70_B$, respectively).

When the high level mixture level detector $70_A$ senses that the mixture level in the application tank 68 is above a predetermined high mixture level, the control device 70 sends a signal to the transfer pump 62 to turn off, thereby stopping the flow of mixture from the preparation tank 44 to the application tank 68. When the low mixture level detector $70_B$ senses that the mixture level in the application tank is below a predetermined low level, the mixture level control device 70 sends a signal to the transfer pump to turn on and, thus, begin to pump additional mixture from the preparation tank 44 to the application tank 68. The mixture level control device 70 also inhibits operation of the water level control device 54 during transfer of the biofungicide mixture 58 to the application tank 68 to prevent additional biofungicide component 18 and water from being added to the mixing tank 44 until transfer is complete. This prevents partially mixed chemicals from inadvertently being transferred to the application tank 68.

An agitator 72 is preferably disposed within the application tank 68 and operates to further mix the biofungicide mixture 58. The agitator is preferably an Air Motor Model No. 4Z411, manufactured by Coast Parts Company of America, Buffalo Grove, Ill.

The preferred embodiment of the biofungicide mixing system 14 discussed above utilizes two mixing tanks 44, 68 to provide complete hydration and suspension of the biofungicide. Since the biofungicide component 18 when first discharged into the preparation tank 44 is in a powder or granular state, it must be hydrated and suspended in a liquid. This usually takes about six minutes. However, the time it takes to fill the preparation tank 44 is only about two minutes. Accordingly, in order to further mix the biofungicide mixture 58, the second (application) tank 68 is utilized.

An additional reason for using two mixing tanks is for consistency. By maintaining the biofungicide mixture 58 in the preparation tank 44 until the correct amount of water and biofungicide component have been added, the resulting biofungicide mixture 58 concentration is relatively consistent, batch after batch.

It is, however, also contemplated that a single mixing tank may be substituted for the dual mixing tanks described above provided the proper concentration and full suspension of the biofungicide is achieved prior to application. The system could be calibrated to maintain a sufficient amount of biofungicide mixture within the single tank for application to the fruit. Those skilled in the art would be readily capable of modifying the dual tank mixing system described above to incorporate a single tank design.

The Biofungicide Delivery System

The biofungicide mixing system 14 described above provides a fully hydrated and suspended biofungicide mixture 58 which is ready for delivery to the post-harvest fruit through the biofungicide delivery system 16.

The biofungicide delivery system 16 includes at least one delivery conduit 74 which is in communication with the biofungicide mixture 58 contained within the application tank 68. Preferably the delivery conduit 74 has one end located within application tank 68 and a second end attached to a delivery pump 76. In the embodiment shown in FIG. 2, the delivery conduit 74 extends through an opening 78 formed in the top of the application tank 68 to the suction side of the delivery pump 76. The delivery pump is preferably a Model 7024-20 pump manufactured by Cole Parmer Instrument Co., Chicago, Ill. A delivery motor 80 is engaged with the delivery pump 76 and controls the operation of the pump. The delivery motor 80 is preferably a Bodine ⅛ horsepower DC gear motor manufactured by Bodine Electric Co., Chicago, Ill. The operation of the delivery pump 76 produces suction in the delivery conduit 74, thereby drawing the biofungicide mixture 58 into the pump 76.

In a preferred embodiment, the delivery motor 80 operates three separate pump heads which each receive a flow of biofungicide mixture 58 through an associated delivery conduit 74. The speed of the delivery motor 80 is regulated by a delivery controller 82 that can be adjusted based on the desired delivery speed (i.e., the biofungicide mixture application speed).

A discharge tube 82 is attached to the discharge side of the delivery pump 76 and delivers a pressurized flow of biofungicide mixture 58 to a dispensing device (not shown) for dispersement on the harvested fruit. Dispensing devices which can be utilized with this system are well known to those skilled in the art and need not be discussed here further.

System Operation

In use, the storage container 20 is filled with a sufficient amount of dry biofungicide component. The preferred system utilizes either Aspire® biofungicide or Decco I-182® biofungicide. The preferred storage container 20 can hold approximately 10 lbs. of biofungicide component which is capable of producing about 90 gallons of biofungicide mixture. Depending on the speed of biofungicide application, this should last approximately six hours.

When the water level control device 54 detects that the level of the liquid (either biofungicide mixture 58 or water) in the preparation tank 44 is low, the control device 54 sends a signal to the feed motor 34 to begin rotating the conveyor 32. The speed of motor (which controls the speed of the conveyor 32 rotation) is governed by the setting on the feed controller 40. A predetermined amount of biofungicide component 18 is fed along the conduit 26 and into the preparation tank 44. After the desired amount of biofungicide component 18 is fed into the preparation tank 44, the water level control device 54 sends a signal to turn the feed motor 34 off.

The water level control device 54 also opens the solenoid valve 52 when the control device 54 detects a low level of liquid in the preparation tank 44. The opening of the solenoid valve 54 permits water to flow into the preparation tank 44. The water and the biofungicide component 18 are mixed together by the agitator 56 to form the biofungicide mixture 58. When the water level control device 54 senses that the liquid in the preparation tank is above the high level detector, the control device 54 closes the solenoid valve 52.

The mixture level control device 70 in the application tank 68 monitors the level of the biofungicide mixture that is present in the application tank 68. When the mixture level control device 70 detects a low level of biofungicide mixture 58 in the application tank 68, it turns the transfer pump 62 on causing biofungicide mixture 58 to flow from the preparation tank 44 to the application tank 68. When the mixture level control device 70 senses that the biofungicide mixture 58 in the application tank 68 is above a high level, the control device 70 shuts off the transfer pump 62, thereby preventing further flow into the application tank 68. The agitator 72 in the application tank 68 continues to mix the biofungicide mixture 58 to form the desired hydrated suspension.

When the delivery motor 80 is turned on, the delivery pump 76 siphons biofungicide mixture 58 from the application tank 68 for discharge onto the harvested fruit. The speed of discharge is controlled by the delivery controller 82.

The above-described preparation cycle continuously repeats itself during the post-harvest treatment of the fruit until the system is shut-off.

As discussed above, the preferred biofungicide is heat sensitive when in a suspension. As such, the above system is designed to utilize cold water, preferably at 25° C., to maximize the useful life of the biofungicide mixture 58. It is also possible to cool the storage container 20 to maintain the biofungicide component 18 at a preferred temperature (for example, at 4° C.) to further extend the life of the biofungicide mixture.

The present invention provides a novel apparatus for preparing a desired amount of biofungicide mixture while minimizing the amount of mixture that is wasted in a daily run. Since smaller batches are made continuously, the odor problems associated with decayed yeast (which can occur in larger bulk tanks) is eliminated. The present invention also simplifies the cleansing of the overall system since it eliminates the bulky mixing tanks.

The precise and continuous mixing provided by the present invention results in substantial operational savings (approximately 10%–20%) by reducing the amount of biofungicide mixture that must be discarded during because of a stoppage in treatment.

Although the invention has been described and illustrated with respect to the exemplary embodiments thereof, it should be understood by those skilled in the art that the foregoing and various other changes, omissions and additions may be made therein and thereto, without parting from the spirit and scope of the present invention.

I claim:

1. An apparatus for preparing a biofungicide mixture for application to harvested fruit, the apparatus comprising:

a storage container adapted to hold a dry biofungicide component, the storage container having an outlet port for permitting egress of the dry biofungicide component;

a conduit mounted to the outlet port in the storage container and adapted to channel the biofungicide component;

a conveyor positioned within at least a portion the conduit and adapted to move within the conduit to convey the biofungicide component through the conduit;

a feed motor engaged to the conveyor for controlling the movement of the conveyor in response to control signals;

a first mixing tank in communication with the conduit and adapted to receive the biofungicide component from the conduit, the first mixing tank also in communication with a water conduit for providing a flow of water into the mixing tank;

an agitator located within the first mixing tank and adapted to mix the biofungicidal component with the water to form a biofungicide mixture;

a first level control device mounted to the first mixing tank for determining the level of the liquid contained therein, the first level control device controlling flow of water along the water conduit into the first mixing tank by actuating a valve between its open and closed position, the first level control device placing the valve in its open position when the level of the liquid within the first mixing tank is below a low threshold level, the first level control device placing the valve in its closed position when the level of the liquid within the first mixing tank is above a high threshold level, the first level control device also controlling startup of the feed motor by turning the motor on when the level of the liquid within the first mixing tank is below the low threshold level;

a second mixing tank;

a transfer pump disposed between and in fluid communication with the first and second mixing tanks, the transfer pump adapted to control flow of biofungicide mixture from the first mixing tank to the second mixing tank;

a second level control device mounted to the second mixing tank for determining the level of the mixture contained therein, the second level control device controlling the operation of the transfer pump, the second level control device turning the transfer pump on when the level of the biofungicide mixture within the second mixing tank is below a low threshold level, and turning the transfer pump off when the level of the biofungicide mixture within the second mixing tank is above a high threshold level;

a delivery conduit in communication with the second mixing tank and adapted to channel a flow of the biofungicidal mixture, the delivery conduit having an end disposed within the second mixing tank for receiving biofungicide mixture therefrom;

a pump having a suction side and a discharge side, the delivery conduit being attached to the suction side of the pump so that suction from the pump causes biofungicidal mixture to flow into the pump; and a discharge tube attached to the discharge side of the pump and adapted to supply a flow of pumped biofungicidal mixture for dispensing on harvested fruit.

2. An apparatus according to claim 1 further comprising a controller in electrical communication with the feed motor, the controller providing control signals to the feed motor for controlling movement of the conveyor.

3. An apparatus according to claim 1 wherein the conveyor is a screw conveyor with at least one flight formed on it for conveying the biofungicide component along the conduit.

4. An apparatus according to claim 1 wherein the second level control device controls the filling of the first tank by inhibiting the filling of the first tank when the transfer pump is on.

5. An apparatus according to claim 4 wherein the second level control device controls the filling of the first tank by preventing the first level control device from turning on the feed motor and opening the valve.

6. An apparatus for preparing a biofingicide mixture for application to harvested fruit, the apparatus comprising:

storage container for holding a dry biofungicide component, the storage container having an outlet port for permitting egress of the dry biofungicide component;

a conduit mounted to the outlet port in the storage container and adapted to channel the biofungicide component;

a screw conveyor rotatably disposed within at least a portion the conduit and adapted to convey the biofungicide component through the conduit;

a feed motor engaged to the conveyor for controlling the movement of the conveyor in response to control signals;

a water conduit for providing a flow of water from a water source;

a preparation tank in communication with the conduit and adapted to receive the biofungicide component therefrom, the preparation tank in communication with the water conduit and adapted to receive a flow of water therefrom;

an agitator located within the preparation tank and adapted to mix the biofungicide component with the water to form a biofungicide mixture;

a water level control device mounted to the preparation tank for determining the level of the liquid contained therein, the water level control device controlling flow of water along the water conduit by actuating a solenoid valve, the water level control device opening the solenoid valve when the level of the liquid within the preparation tank is below a low threshold level and closing the solenoid valve when the level of the liquid within the preparation tank is above a high threshold level, the water level control device also starting the feed motor when the level of the liquid within the preparation tank is below a low threshold level;

a transfer pump in communication with the preparation tank and an application tank, the transfer pump adapted to transfer biofungicide mixture from the preparation tank to the application tank;

a mixture level control device mounted to the application tank for determining the level of the mixture contained therein, the mixture level control device controlling the operation of the transfer pump, the mixture level control device turning the transfer pump on when the level of the biofungicide mixture within the application tank is below a low threshold level, and turning the transfer pump off when the level of the biofungicide mixture within the application tank is above a high threshold level, the mixture level control device also controlling the filling of the preparation tank by inhibiting the filling of the preparation tank when the transfer pump is on; and a delivery pump in communication with the application tank and adapted to pump biofungicide mixture through a discharge tube.

7. An apparatus according to claim 6 wherein communication between the transfer pump and the preparation tank is provided by a first transfer pipe, and wherein communication between the transfer pump and the application tank is provided by a second transfer pipe.

8. An apparatus according to claim 6 wherein communication between the delivery pump and the application tank is provided by a delivery conduit having one end disposed in the application tank and another end attached to an inlet side of the delivery pump.

9. An apparatus according to claim 6 further comprising a delivery motor for controlling the operation of the delivery pump; and a delivery controller for controlling the operation of the delivery motor.

10. An apparatus according to claim 6 wherein the mixture level control device controls the filling of the preparation tank by preventing the water level control device from turning on the feed motor and opening the valve.

11. An apparatus for preparing a biofungicide mixture for application to harvested fruit, the apparatus comprising:

a dry biofungicide feeding system for feeding a dry biofungicide component, the dry biofungicide feeding system including a storage container for holding a dry biofungicide component, the storage container having an outlet port for permitting passage of a dry biofungicide component out of the container, a conduit mounted to the outlet port in the storage container and adapted to channel the biofungicide component, a conveyor disposed within at least a portion the conduit and adapted to convey the biofungicide component through the conduit, and a motor for controlling the conveyor;

a biofungicide mixing system for mixing the biofungicide component with water to create a mixture, the mixing system including a preparation tank adapted to receive the biofungicide component, the preparation tank also receiving water from a water source, an agitator located within the preparation tank and adapted to mix the biofungicide component with the water to form a biofungicide mixture, a water level control device mounted to the preparation tank for determining the level of the liquid contained within the tank, the water level control device controlling flow of water into the preparation tank by actuating a valve, the water level control device opening the valve when the level of the liquid within the preparation tank is below a low threshold level and closing the valve when the level of the liquid within the preparation tank is above a high threshold level, the water level control device also starting the feed motor when the level of the liquid within the preparation tank is below a low threshold level, a transfer pump in communication with the preparation tank and an application tank, the transfer pump adapted to transfer biofungicide mixture from the preparation tank to the application tank, and a mixture level control device mounted to the application tank for determining the level of the mixture contained therein, the mixture level control device controlling the operation of the transfer pump, the mixture level control device turning the transfer pump on when the level of the biofungicide mixture within the application tank is below a low threshold level, and turning the transfer pump off when the level of the biofungicide mixture within the application tank is above a high threshold level; and a biofungicide delivery system for delivering biofungicide mixture for treatment of harvested fruit, the delivery system including a delivery pump in communication with the application tank and adapted to suction biofungicide mixture from the application tank, the delivery pump adapted to channel the biofungicide through a discharge tube to the harvested fruit.

* * * * *